US006528773B2

(12) United States Patent
Kim et al.

(10) Patent No.: US 6,528,773 B2
(45) Date of Patent: Mar. 4, 2003

(54) MICROWAVE OVEN WITH A CONVECTION HEATER AND AIRFLOW MECHANISM TO OPTIMIZE CONVECTION COOKING

(75) Inventors: Yang Kyeong Kim, Inchon (KR); Jong Gwan Ryu, Seoul (KR); Sung Jin Han, Seoul (KR); Wan Soo Kim, Kwangmyung (KR)

(73) Assignee: LG Electronics Inc. (KR)

( * ) Notice: Subject to any disclaimer, the term of this patent is extended or adjusted under 35 U.S.C. 154(b) by 0 days.

(21) Appl. No.: 09/750,518

(22) Filed: Dec. 28, 2000

(65) Prior Publication Data

US 2001/0032840 A1 Oct. 25, 2001

(30) Foreign Application Priority Data

Apr. 19, 2000 (KR) ..... 2000-20633
Apr. 19, 2000 (KR) ..... 2000-20640
Apr. 19, 2000 (KR) ..... 2000-20641

(51) Int. Cl.[7] ..... H05B 6/80

(52) U.S. Cl. ..... 219/681; 219/685; 219/756; 219/757; 219/400; 219/536; 126/21 A

(58) Field of Search ..... 219/681, 685, 219/756, 757, 400, 536, 537; 126/21 A

(56) References Cited

U.S. PATENT DOCUMENTS 3,692,968 A * 9/1972 Yasuoka ..... 219/681
3,716,687 A * 2/1973 Constable ..... 219/681
4,137,442 A * 1/1979 Tateda ..... 219/685
4,154,861 A * 5/1979 Smith ..... 219/681
4,332,992 A * 6/1982 Larsen et al. ..... 219/681
4,870,255 A * 9/1989 Fujii et al. ..... 219/681
5,483,044 A * 1/1996 Thorneywork et al. ..... 219/681
6,060,701 A * 5/2000 McKee et al. ..... 219/681

FOREIGN PATENT DOCUMENTS

DE 3116057 C2 7/1994
GB 2074310 A 10/1981

* cited by examiner

*Primary Examiner*—Philip H. Leung
(74) *Attorney, Agent, or Firm*—Ostrolenk, Faber, Gerb & Soffen, LLP

(57) ABSTRACT

The present invention relates to a microwave oven including a cavity having a certain area for cooking comprising a flow path formed between a main body and the cavity so as to be connected from a side of the cavity to the upper surface of the cavity, a heater installed on the side of the flow path corresponding to the outer upper surface of the cavity for emitting heat, a discharge hole installed on the upper surface of the cavity corresponding to the lower portion of the heater for discharging the heat of the heater into the cavity, an inlet installed on the lower portion of the side wall of the cavity for making the air inside of the cavity flow in the flow channel, and a circulating fan installed on a certain portion of the flow channel for circulating the air inside of the cavity flown through the inlet to the heater. Accordingly, the microwave oven of the present invention is capable of maximizing the heat exchange efficiency between the heater and air, increasing the heat efficiency, and heightening the cooking quality and cooking speed by improving the heat transmission structure of the heater providing the heat to the cavity.

19 Claims, 8 Drawing Sheets

AIR SPEED,
PASSAGE AREA OPTIMUN

AIR SPEED:9~13m/s , PASSAGE AREA:26cm$^2$

AIR SPEED LOW,
PASSAGE AREA OVER LARGE

AIR SPEED:9~13m/s , PASSAGE AREA:147cm$^2$

MICROWAVE OVEN WITH A CONVECTION HEATER AND AIRFLOW MECHANISM TO OPTIMIZE CONVECTION COOKING

BACKGROUND OF THE INVENTION

1. Field of the Invention

The present invention relates to a microwave oven, and in particular to a microwave oven which is capable of improving a cooking quality and cooking time by elevating heat efficiency of a heater.

2. Description of the Prior Art

A microwave oven cooks foodstuff by utilizing molecular motion of the foodstuff by using 2,450 MHz microwave.

FIG. 1 is a perspective view illustrating a microwave oven according to the conventional technology, and FIG. 2 is a sectional view illustrating a microwave oven according to the conventional technology.

As depicted in FIG. 1 and FIG. 2, the microwave oven comprises a main body including a cavity 10 where the foodstuff is cooked, an electric room 12 installed various electric units, and a door 14 installed on the front of the main body for opening/closing the cavity.

The electric room 12 includes a magnetron 16 generating high frequency, and a high voltage transmitter 18 and a high voltage capacitor 20 for applying a high voltage to the magnetron 16.

In addition, a radiating fan 22 for cooling the electric parts by sucking the outer air and an operating motor (not shown) for operating the radiating fans are installed at the rear side of the electric room 12.

And, a tray 25 to be mounted on the foodstuff is installed in the cavity 10, and a transparent window 26 for seeing through the cavity when the door 14 is closed is installed on the door 14.

A heater 28 for providing heat inside of the cavity 10 in a cooking state and a heater housing 30 for covering the heater 28 are installed between the rear wall of the cavity 10 and a casing 11.

A plurality of discharge holes 30*a* for discharging the heat of the heater 28 into the cavity 10 and a plurality of suction holes for suctioning the inner air of the cavity 10 which is used for cooking the foodstuff to the heater 28 are formed on the inner rear wall of the cavity 10.

And, a blast fan 32 for making the air flow so as to circulate through the discharge holes 30*a* and suction holes 30*b* of the cavity, and an operating motor for operating the blast fan 32 are installed on the heater housing 30.

The operation of the above described conventional microwave oven will now be described.

First, when the blast fan 32 is operated in the cooking state, the inner air of the cavity 10 flows to the heater housing 30 through the suction holes 30*b* by rotary force of the blast fan 32.

The air flowed to the heater housing 30 is heated through the heater by heat exchange with the heater 28, and is discharged into the cavity 10 through the plurality of discharge holes 30*a*.

The high temperature air discharged into the cavity 10 heats the foodstuff, and flows to the heater housing 30 through the suction holes 30*b*, accordingly the foodstuff can be cooked by repeating above process.

However, the above described conventional microwave oven does not comprise a heat transmission means for transmitting efficiently heat energy generated from the heater 28, accordingly heat efficiencies of convection energy and radiant energy are lower, therefore the efficiency of the heater 28 is lower and cooking efficiency of the microwave oven is worse.

SUMMARY OF THE INVENTION

It is an object of the present invention to provide a heating device of a microwave oven which is capable of increasing heat efficiency of the heater and cooking quality and cooking speed by improving a heat transfer structure of the microwave oven so as to heighten heat transmission efficiency between the heater and air.

To achieve the object, a microwave oven including a cavity having a certain area for cooking of the present invention comprises a flow path formed between a main body and the cavity so as to be connected from a side of the cavity to the upper surface of the cavity, a heater installed on the side of the flow path corresponding to the outer upper surface of the cavity for emitting heat, a discharge hole installed on the upper surface of the cavity corresponding to the lower portion of the heater for discharging the heat of the heater into the cavity, an inlet installed on the lower portion of the side wall of the cavity for making the air inside of the cavity flow to the flow channel, and a circulating fan installed on a certain portion of the flow channel for circulating the air inside of the cavity flowed through the inlet to the heater.

In addition, in the microwave oven of the present invention, there are a plurality of discharge holes installed as concentric circles centering around the discharge hole on the center portion, and it is advisable to form the discharge hole adjacent utmost to the circulating fan so as to be the smallest among the plurality of discharge holes.

In addition, in the conventional microwave oven of the present invention, there are the plurality of discharge holes installed along the width direction of the flow path, and it is advisable to form the discharge hole formed on the center portion so as to be the smallest among the plurality of discharge holes.

In addition, in the conventional microwave oven of the present invention, when the high temperature air circulated by the circulating fan passes through the discharge holes, the maximum discharge speed is maintained as air velocity 9~13 m/s, passage dimension is maintained as 26~38 $cm^2$, air volume circulated through the discharge holes is maintained as 1.4~2.0 $m^3$/min when heat value is 3 kW, when the heat value is bigger/smaller than 3 kW, the air volume is changed in proportion to the heat value.

In addition, in the microwave oven of the present invention, it is advisable to from a reflecting plate on the external surface of the heater so as to cover the heater in order to provide whole radiant energy emitted from the heater to the cavity.

In addition, in the microwave oven of the present invention, it is advisable to form a plurality of circulation holes on a portion corresponding to the circulating fan in order to pass the circulating air inside of the cavity.

In addition, in the microwave oven of the present invention, it is advisable to form the heater so as to be zigzag-curved, and a heating plate for increasing heating dimension is installed on the heater.

In addition, in the microwave oven of the present invention, it is advisable to install the heater so as to be crossed on the square with the flow direction of the circulating air in order to increase the quantity of heat transmission between the heater and circulating air by always getting a maximum temperature difference between the heater and the circulating air.

In addition, in the microwave oven of the present invention, it is advisable to install the heater so as to be inclined at a certain degree to the flow direction of the circulating air in order to increase the quantity of heat transmission between the heater and circulating air by always getting a maximum temperature difference between the heater and circulating air.

In addition, in the microwave oven of the present invention, it is advisable to form the plurality of heating plates having through holes at the center portion so as to be penetrated and contacted by the heater.

In addition, in the microwave oven of the present invention, it is advisable to form a contact protrusion on the circumference of the through holes of the heating plates in order to increase the contact surface with the heater.

DETAILED DESCRIPTION OF THE PREFERRED EMBODIMENTS

The present invention will now be described in detail with reference to the accompanying drawings.

Figure 1:
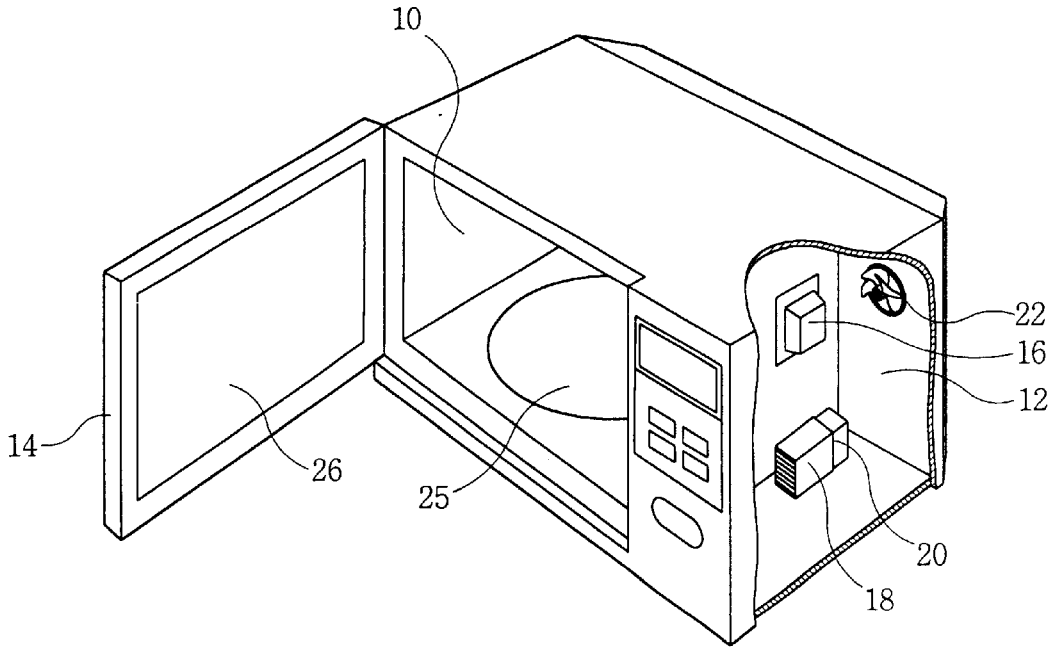
FIG. 1 BACKGROUND ART
FIG. 1 is a schematic perspective view illustrating a microwave oven according to the conventional technology.
Figure 2:
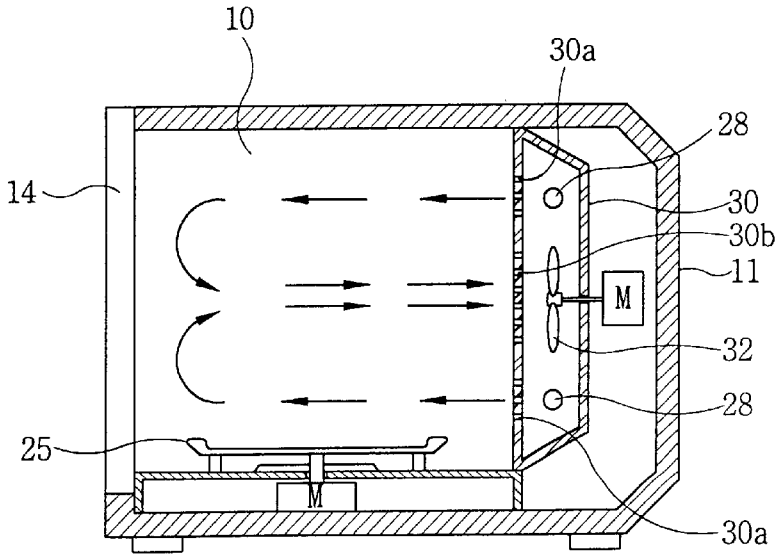
FIG. 2 BACKGROUND ART
FIG. 2 is a schematic sectional view illustrating the conventional microwave oven.
Figure 3:
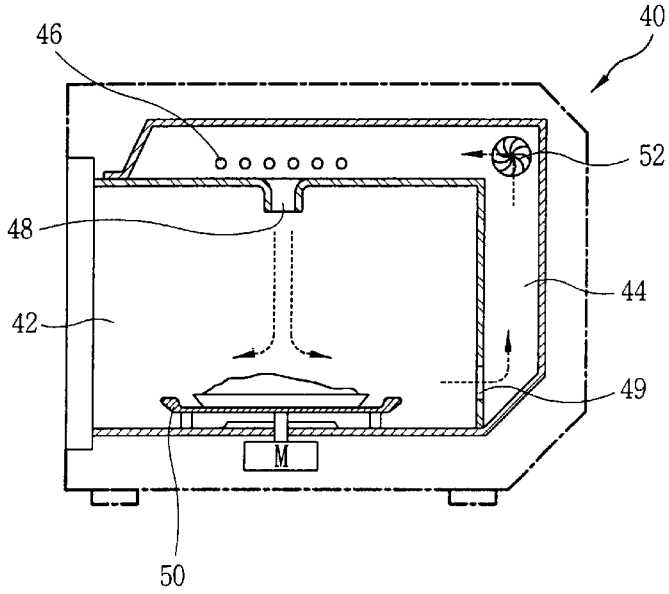
FIG. 3 is a schematic perspective view illustrating a microwave oven according to the present invention.
Figure 4A:
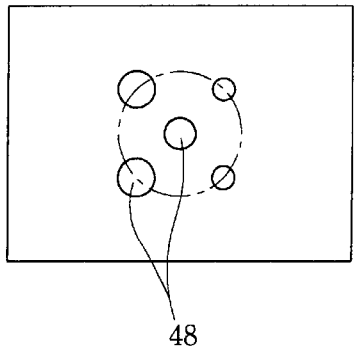
FIGS. 4*a* and 4*b* are plan views illustrating embodiments of discharge holes of the present invention.
Figure 4B:
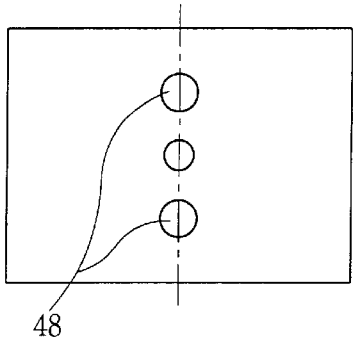
Figure 5A:
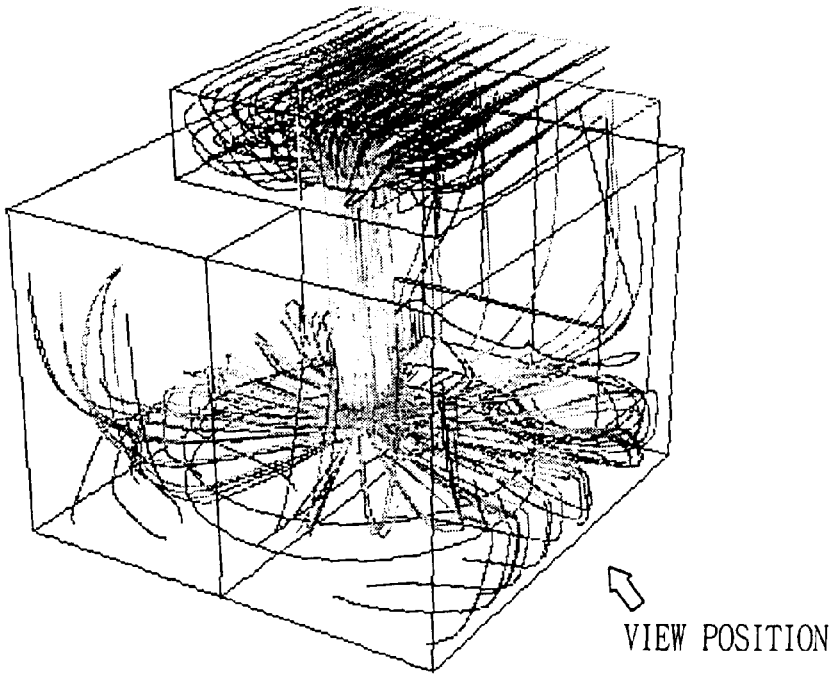
FIG. 5*a* is a perspective view illustrating a flow state of the air discharged into a cavity of a microwave oven adopting air velocity and flow area of the present invention.
Figure 5B:
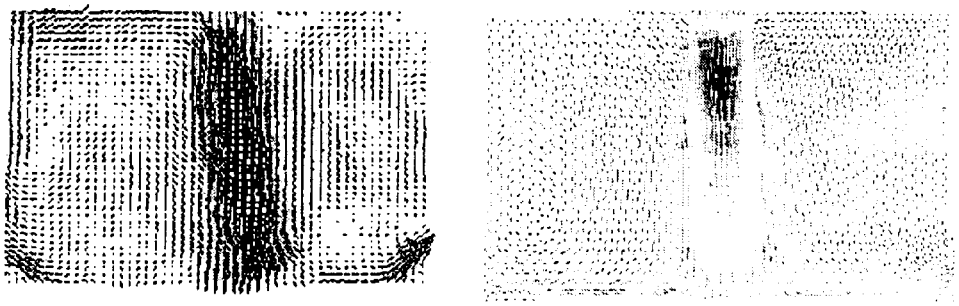
FIG. 5*b* illustrates an flow visualization experiment adopting air velocity and flow area of the present invention.
Figure 6A:
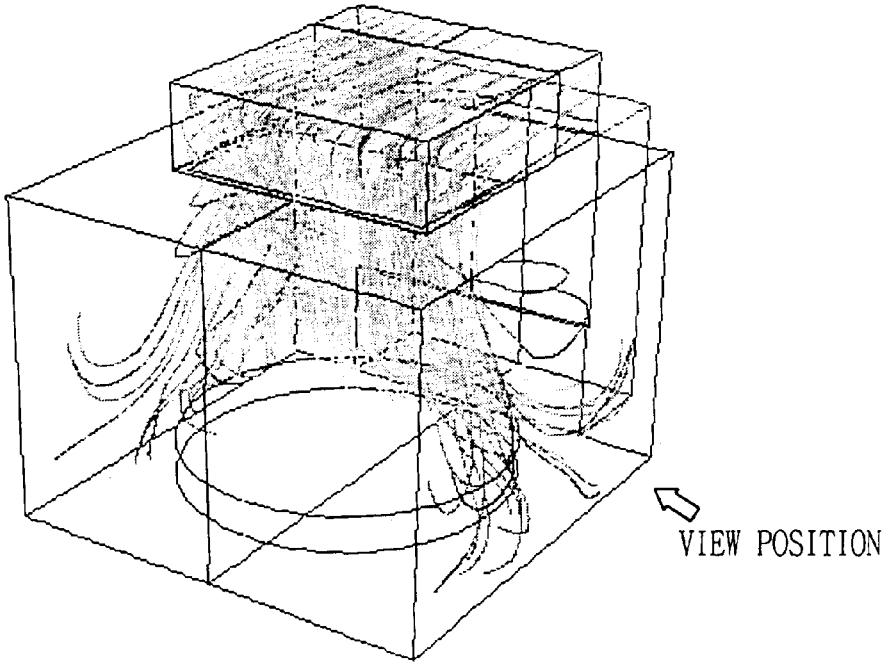
FIG. 6*a* is a perspective view illustrating a flow state of the air discharged into a cavity of a microwave oven adopting different air velocity and flow area in order to compare to the present invention.
Figure 6B:
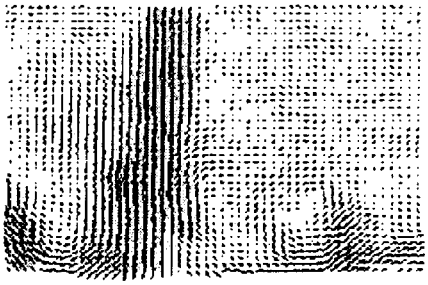
FIG. 6*b* illustrates an flow visualization experiment adopting different air velocity and flow area in order to compare to the present invention.
Figure 6B:
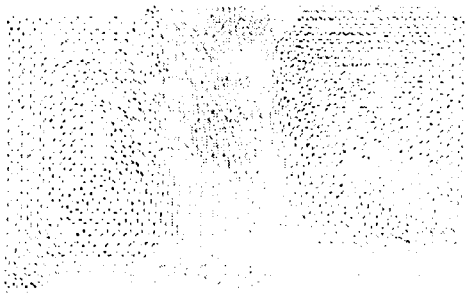

FIG. 3 is a schematic perspective view illustrating a microwave oven according to the present invention. FIGS. 4*a* and 4*b* are plan views illustrating embodiments of discharge holes of the present invention. FIG. 5*a* is a perspective view illustrating a flow state of the air discharged into a cavity of a microwave oven adopting air velocity and flow area of the present invention. FIG. 5*b* illustrates a flow visualization experiment adopting air velocity and flow area of the present invention. FIG. 6*a* is a perspective view illustrating a flow state of the air discharged into a cavity of a microwave oven adopting different air velocity and flow area in order to compare to the present invention. FIG. 6*b* illustrates a flow visualization experiment adopting different air velocity and flow area in order to compare to the present invention.

In a microwave oven of the present invention, a flow path 44 is formed between a main body 40 forming the exterior of the microwave oven and a cavity 42 as a cooking space inside of the main body so as to be ventable from the side surface of the cavity 42 to the upper surface of the cavity 42, and a heater 46 is installed on the exterior of the upper surface of the cavity 42.

A discharge hole 48 is formed on the upper surface of the cavity 42 as lower portion of the heater 46 in order to discharge heat of the heater into the cavity, and an inlet 49 is formed on the lower side surface of the cavity 42 in order to make the air inside of the cavity 42 flow to the flow path 44.

A circulating fan 52 is installed on the curved portion of the flow path 44 upwardly curved to the upper surface of the cavity 42 along the sidewall of the cavity 42 in order to circulate the air inside of the cavity 42 to the heater 46.

It is advisable to form the discharge hole as more than one hole on the upper center portion of the cavity 42. When the one discharge hole 48 is formed, heating is intensively performed only on the portion corresponding to the discharge hole, accordingly it is advisable to diversify distribution of the discharge quantity to the wide dimension by increasing the number of the discharge holes 48 and decreasing the size of the each discharge hole while overall flow quantity and air velocity is kept, and the flow quantity has to be generated more on the edge portions rather than the center portion because the heating dimension increases as foodstuff recedes from the center portion.

Accordingly, it is advisable to form a plurality of discharge holes having different diameters centering around the discharge hole 48, the plurality of discharge holes can be formed as a circle illustrated in FIG. 4*a*, or the plurality of discharge holes can be formed as a straight line illustrated in FIG. 4*b*.

In the circle structure described in FIG. 4*a*, the plurality of discharge holes 48 having different diameters are formed as a concentric circle centering around the discharge hole 48 on the center portion, a discharge current having a column shape is formed during cooking, it can evenly heat the foodstuff relatively without rotating operation of the tray 50 during cooking, however the each discharge hole 48 has different distance from a circulating fan 52, accordingly it is required to optimize the dimension of the discharge holes, and it is advisable to decrease the size of the discharge holes according as the distance is close.

In addition, in the straight line structure described in FIG. 4*b*, it can evenly cook the foodstuff when the rotating tray 50 operates, each discharge hole 48 has a regular position on the flow path, and a discharge air current having a curtain shape is formed. In order to heat the foodstuff evenly the size of the center discharge hole 48 has to be the smallest.

In addition, in the cooking state of the microwave oven, in order to decrease the cooking time and improve the cooking quality, optimum design and operating condition are required corresponding to air volume circulating by the rotation of the circulating fan 52, air velocity from the discharge hole 48 and size and position of the discharge hole 48. As a result of experiments it is advisable to keep the air velocity which is the maximum discharge speed at a position one centimeter apart from the lower end portion of the discharge hole 48 as 9~13 m/s, and as described above it is advisable to form a plurality of discharge holes 48.

And, the passage dimension of the overall flow path discharged through the discharge hole 48 is kept as 26~38 $cm^2$, the air volume circulating to the discharge hole 48 by the rotation of the circulating fan 52 is kept as 1.4~2.0 $m^3$/min when the heating quantity is 3 kW. When the heating quantity is bigger/smaller than 3 kW, the air volume is changed in proportion to the heating quantity. When the discharge hole 48 discharges downwardly, the position of the discharge hole 48 has to be in the range of the foodstuff.

In other words, as depicted in FIGS. 6*a* and 6*b* in order to compare to the present invention, when the air velocity as the maximum discharge speed 1 cm apart from the lower end portion of the discharge hole 48 is kept as 9~13 m/s and the flow dimension is 147 $cm^2$, the flow of the heat energy discharged through the discharge hole 48 is distributed, the flow rate is small on the bottom surface of the cavity 42, accordingly the heat transfer is low. On the contrary, as depicted in FIGS. 5*a* and 5*b*, in the present invention when the air velocity as the maximum discharge speed 1 cm apart from the lower end portion of the discharge hole 48 is kept as 9~13 m/s and the flow dimension is 26 $cm^2$, a strong discharge flow of the heat energy discharged through the discharge hole 48 is quickly transmitted to the bottom surface of the cavity 42.

Figure 7:
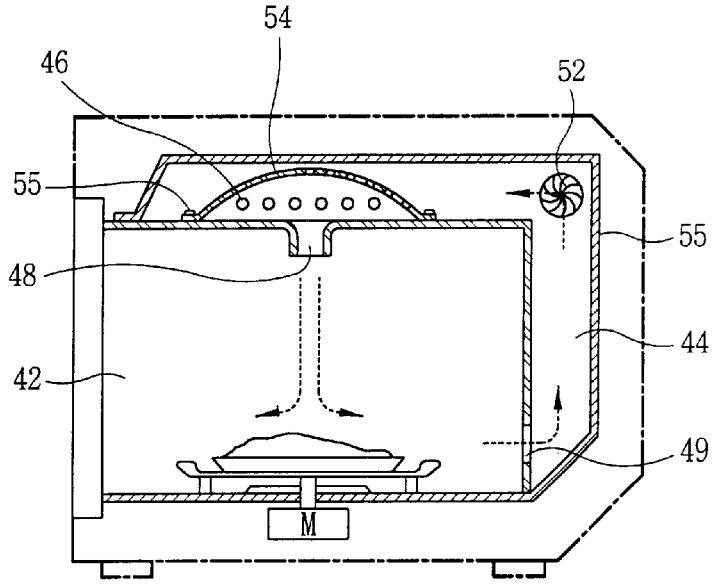
FIG. 7 is a sectional view illustrating a microwave oven comprising a reflecting plate according to the embodiment of the present invention.
Figure 8:
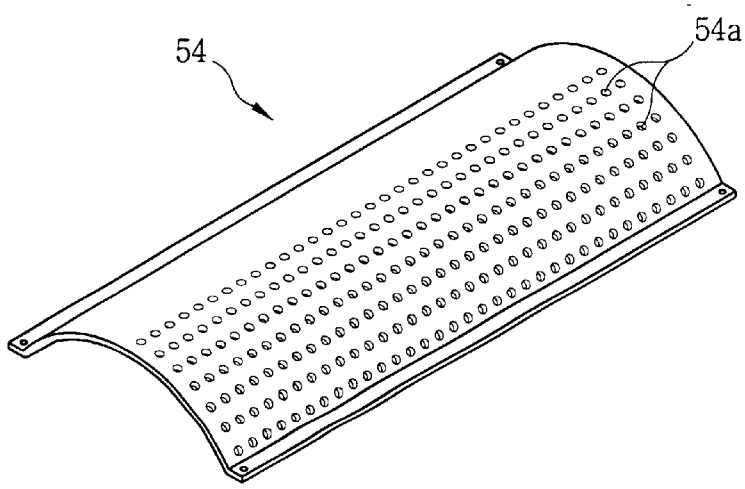
FIG. 8 is a perspective view illustrating a heating plate in FIG. 7.

Meanwhile, FIG. 7 is a sectional view illustrating a microwave oven comprising a reflecting plate according to the embodiment of the present invention, and FIG. 8 is a perspective view illustrating the heating plate in FIG. 7.

As depicted in FIG. 7, the microwave oven according to the embodiment of the present invention comprises a heater 46 for providing heat inside of the cavity 42 in order to cook the foodstuff, and a reflecting plate 54 installed on the circumference of the heater 46 for reflecting the radiant energy discharged from the heater 46 in order to provide the radiant energy all to the inside of the cavity 42.

The heater 46 is installed on the outer upper surface of the cavity 42, and the discharge hole 48 is formed on the lower portion of the heater 46 in order to discharge the heat of the heater 46 inside of the cavity 42.

And, an inlet 49 for circulating the air inside of the cavity 42 used for cooking the foodstuff to the heater 46 is formed on the lower sidewall of the cavity 42, and the inlet 49 and discharge hole 48 are connected by the flow path 44.

And, a circulating fan 52 for making the air flow by force is installed on the flow path 44 in order to make the air inside of the cavity 42 circulate continually through the inlet 49 and discharge hole 48.

And, the reflecting plate 54 having a half cylindrical shape covering the upper portion of the heater 46 includes a plurality of circulating holes 54*a* on the portion corresponding to the circulating fan 52 in order to circulate the air to the heater 46.

Herein, the reflecting plate 54 can be fabricated as various shapes such as a cone shape or a square shape besides the half cylindrical shape.

The reflecting plate 54 is fasten-combined on the outer upper surface of the cavity 52 by a fastening screw 55.

The microwave oven according to the embodiment of the present invention cooks the foodstuff by providing the radiant energy discharged from the heater 46 into the cavity 42 through the discharge hole 48 on the upper surface of the cavity 42 in the cooking state using the heater 46.

Herein, the energy discharged to the upward direction of the heater 46 among the radiant energy discharged from the heater 46 is reflected by the reflecting plate 54 and is provided toward the foodstuff inside of the cavity 42.

While the foodstuff is cooked by the radiant energy of the heater 46, the foodstuff is also cooked by the convection energy discharged from the heater 46. In other words, the convection energy is generated by the operation of the circulating fan 52 making the air inside of the cavity 42 circulate through the flow path 44.

In the meantime, the air passing through the reflecting plate 54 cools the reflecting plate 54 by passing through the circulating holes 54*a*. In other words, the reflecting plate 54 inclines to overheat by absorbing part of the radiant energy while reflecting the radiant energy discharged from the heater 46, the heat of the reflecting plate 54 is cooled by performing heat exchange while the air is circulated by the operation of the circulating fan 52.

Accordingly, when the microwave oven is operated for a long time, the reflecting character of the reflecting plate 54 is kept constant and at the same time distortion of the reflecting plate 54 is prevented without additional cooling apparatus because the cooling of the reflecting plate 54 is naturally performed with the flow of the air.

The microwave oven operated as above is suitable for the structure using the radiant energy mainly for cooking the foodstuff by the heat energy discharged from the heater 46, and it is advisable for the heater 46 to be of a type where the radiant energy is 70% of the overall energy and the convection energy is 30% of the overall energy such as a heater using a halogen tube, a ceramic tube, a quartz tube or a micron heater.

Meanwhile, the other embodiment of the present invention will now be described in detail with reference to the accompanying drawings.

Figure 9:
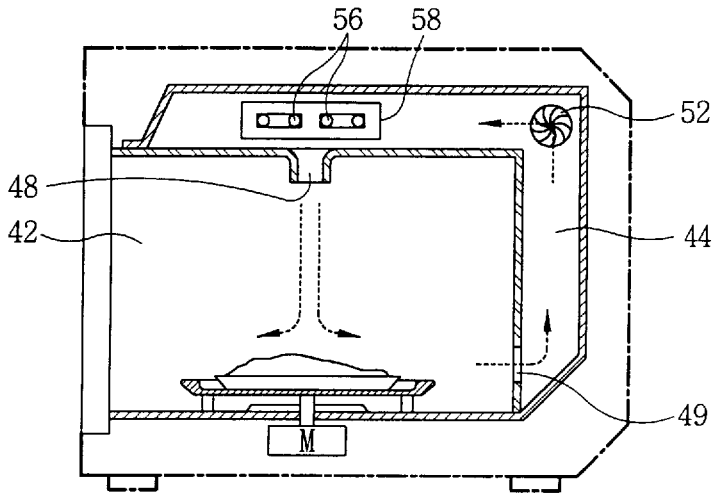
FIG. 9 is a sectional view illustrating a microwave oven according to the other embodiment of the present invention.
Figure 10:
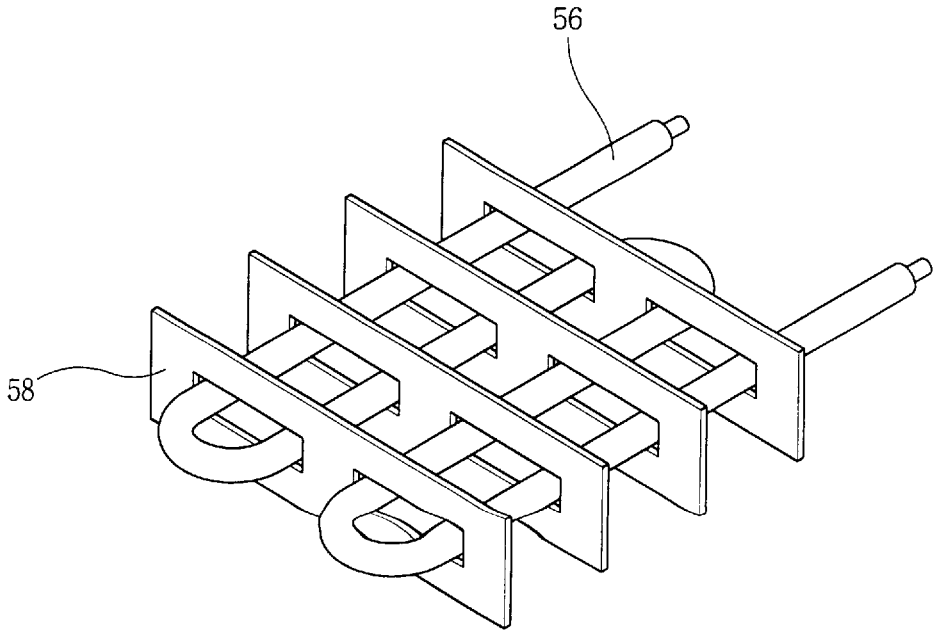
FIG. 10 is a perspective view illustrating a connection state of the heater and heating plate in FIG. 9.
Figure 11:
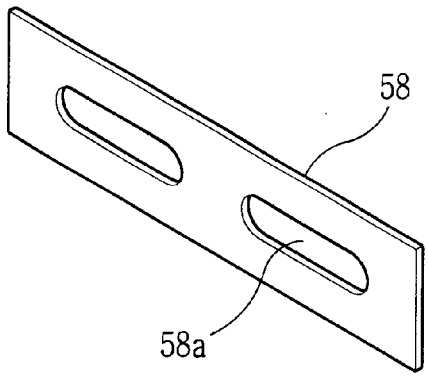
FIG. 11 is a perspective view illustrating the heating plate in FIG. 10 according to the other embodiment of the present invention.
Figure 12:
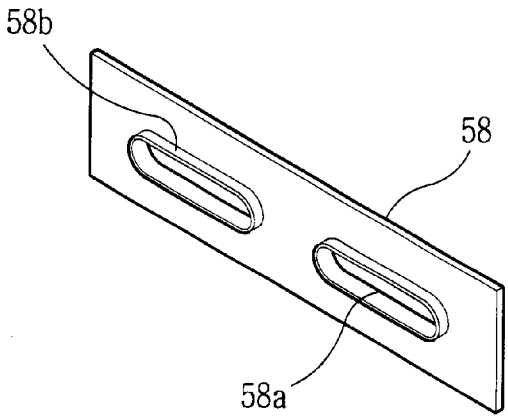
FIG. 12 is a perspective view illustrating the heating plate in FIG. 10 according to the other embodiment of the present invention.
Figure 13:
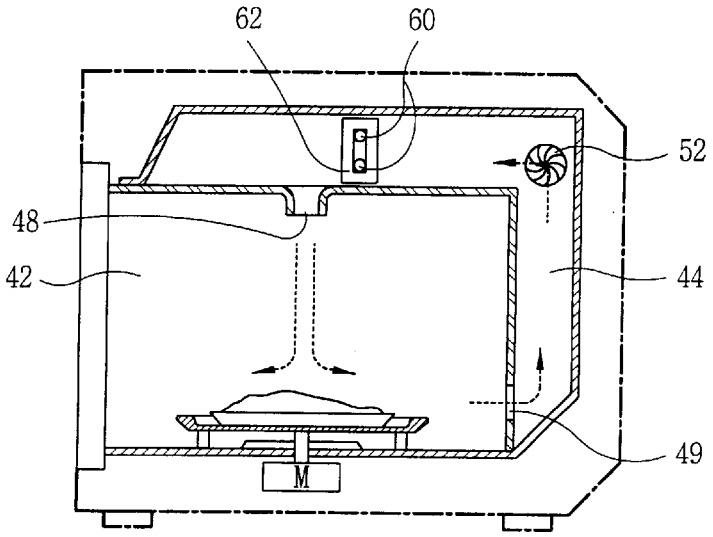
FIGS. 13 and 14 are sectional views illustrating the microwave oven in FIG. 9 according to the other embodiment of the present invention.
Figure 14:
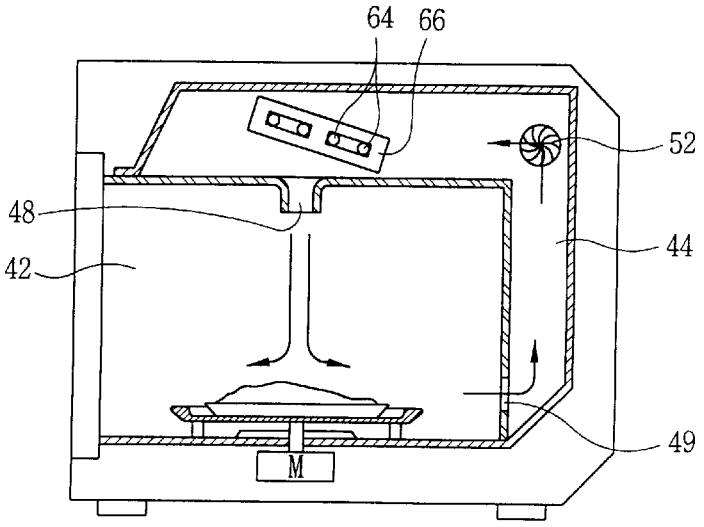

FIG. 9 is a sectional view illustrating a microwave oven according to the other embodiment of the present invention. FIG. 10 is a perspective view illustrating a connection state of the heater and heating plate in FIG. 9. FIGS. 11 and 12 are perspective views illustrating the heating plate in FIG. 10 according to the other embodiment of the present invention. FIGS. 13 and 14 are sectional views illustrating the microwave oven in FIG. 9 according to the other embodiment of the present invention.

The microwave oven according to the other embodiment of the present invention comprises a heater 56 having a bar shape zigzag-curved and parallel-arrayed on the upper surface of the cavity 42, and a plurality of heating plates 58 for increasing the heating dimension by combining to the heater 56 in order to cook the foodstuff.

The each heating plate 58 has a square plate shape including a through hole 58*a* on the both sides where the two strands of the heater 51 penetrate in order to get the assembly with the heater easy.

Herein, the through holes 58*a* can be formed as the square shape, as depicted in FIG. 11, the each corner of the through hole can be rounded in order to increase the contact dimension between the heater 56 and heating plate 58, as depicted in FIG. 12, a contact protrusion 58*b* can be formed by expanding the circumference of the through hole 58*a*.

The operation of the microwave oven constructed as above according to the other embodiment of the present invention will now be described.

First, when a user applies a power to the microwave oven, the circulating fan 52 inside of the flow path 44 is operated, the air inside of the cavity 42 flows into the flow path 44 through the inlet 49 by the rotating force of the circulating fan 52.

After that, the air flowed into the flow path 44 is transferred to the heater 56, and is heated as high temperature by passing through the heater 56.

Herein, the convection heat transmission between the heater 56 and air increases in proportion to the heating dimension and temperature difference between the heater 56 and air, the plurality of the heating plates 58 are installed on the heater 56, the heating dimension between the heater 56 and air is increased by the heating plates 58, accordingly the convection heat transmission quantity transmitted from the heater 56 and air increases a lot, and the heat efficiency between the heater 56 and air improves a lot.

As described above, the high temperature air heated by the heat transmission from the heater 56 is provided inside of the cavity 42 by the circulating fan 52, provides the convection energy to the foodstuff, and performs the cooking of the foodstuff with the radiant energy discharged from the heater itself 51.

Likewise, the air lost the heat of itself for cooking the foodstuff flows into the flow path 44 through the inlet 49, and the above operation is performed repeatedly.

In the meantime, FIGS. 13 and 14 illustrate the other embodiment of the present invention, and it will now be described.

In the embodiment of FIG. 13, the heater 60 combined to the heating plate 62 on the outer upper surface of the cavity 42 is crossed on the square with the air flow direction so as not to be overlapped on the same flow direction of the air.

When the heater 60 is installed as above, it can prevent the heat transmission of the air which is heat transmitted once while passing through the first heater portion of the curved heater 60 having a plurality of strands when the air passes the other heater portion 60 installed following the first.

Accordingly, the each heater portion curved so as to have a plurality of strands can always meet the lowest temperature, the temperature difference between the heater 60 and air is always maximum, accordingly the convection heat transmission quantity from the heater 60 and heat transmission efficiency can be improved.

The each portion of the heater 64 curved so as to have the plurality of strands combined to the heating plate 66 on the outer upper surface of the cavity 42 is installed so as to be inclined to the flow direction of the air in order to prevent the each portion of the heater 64 from being overlapped-placed to the same flow direction of the air.

When the heater is installed so as to be inclined, the heat exchange efficiency can be maximized between the heater 64 and air because the bigger heater 64 can be installed on the space having same height of the embodiment in FIG. 13 with the same effect.

As described above, the microwave oven of the present invention is capable of maximizing the heat exchange efficiency between the heater and air, increasing the heat efficiency, and heightening the cooking quality and cooking speed by improving the heat transmission structure of the heater providing the heat to the cavity.

What is claimed is:

1. A microwave oven comprising:

a main body constituting an exterior of the microwave oven;

a cooking cavity contained in the main body, and having an upper surface, a lower surface and side walls;

a flow path formed between the main body and the cooking cavity, and having a suction port formed in a side wall of the cooking cavity and a discharge port formed in the upper surface of the cooking cavity;

a circulating fan installed in the flow path for making air flow from the inside of the cooking cavity to the flow path through the suction port, and from the inside of the flow path to the inside of the cooking cavity through the discharge port; and;

a heater installed near said discharge port in the flow path for heating air flowing from the flow path to the inside of the cooking cavity, wherein the maximum air velocity through the discharge port is 9~13 m/s, a sectional area of the discharge port is 26~38 $cm^2$, air volume circulated through the discharge port is about 1.4~2.0 $m^3$/min and a heater power level is maintained at about 3 kW.

2. A microwave oven comprising:

a main body constituting an exterior of the microwave oven;

a cooking cavity contained in the main body, and having an upper surface, a lower surface and side walls;

a flow path formed between the main body and the cooking cavity, and having a suction port formed in a side wall of the cooking cavity and a discharge port formed in the upper surface of the cooking cavity;

a circulating fan installed in the flow path for making air flow from the inside of the cooking cavity to the flow path through the suction port, and from the inside of the flow path to the inside of the cooking cavity through the discharge port; and a heater installed near said discharge port in the flow path for heating air flowing from the flow path to the inside of the cooking cavity, wherein the heater comprises a heating element having a zigzag-curved and paralleled shape and a plurality of heating plates formed with one or more slots therein through which the heating element is inserted for enhancing heat transfer from the heating element to the air.

3. The microwave oven according to claim 2, wherein the heating element is arranged in a plane perpendicular to the flow direction of the air in order to enhance heat transfer between the heater and the air.

4. The microwave oven according to claim 2, wherein the heating element is arranged in a plane inclined relative to the flow direction of the air in order to enhance heat transfer between the heater and the air.

5. The microwave oven according to claim 2, wherein a contact protrusion is formed on a circumference of the slot of the heating plate in order to increase contact area with the heater.

6. A microwave oven comprising:

a main body constituting an exterior of the microwave oven;

a cooking cavity contained in the main body, and having an upper surface, a lower surface and side walls;

a flow path formed between the main body of the cooling cavity, and having a suction port formed in a side wall of the cooking cavity and a discharge port formed in the upper surface of the cooking cavity;

a circulating fan installed in the flow path for making air flow from the inside of the cooking cavity to the flow path through the suction port, and from the inside of the flow path to the inside of the cooking cavity through the discharge port; and a heater installed near said discharge port in the flow path for heating air flowing from the flow path to the inside of the cooking cavity, wherein the discharge port comprises a plurality of discharge holes, and the discharge holes located closer to the circulating fan are smaller in size than the discharge holes located farther from the circulating fan.

7. The microwave oven according to claim 6, wherein the plurality of discharge holes comprises a center discharge hole and outer discharge holes arranged around the center discharge hole.

8. The microwave oven according to claim 6, wherein the heater comprises a heating element having a zigzag-curved and paralleled shape and a plurality of heating plates formed with one or more slots therein through which the heating element is inserted for enhancing heat transfer from the heating element to the air.

9. The microwave oven according to claim 8, wherein the heating element is arranged in a plane perpendicular to the flow direction of the air in order to enhance heat transfer between the heater and the air.

10. The microwave oven according to claim 8, wherein the heating element is arranged in a plane inclined relative to the flow direction of the air in order to enhance heat transfer between the heater and the air.

11. The microwave oven according to claim 8, wherein a contact protrusion is formed on a circumference of the slot of the heating plate in order to increase contact area with the heater.

12. A microwave oven comprising:

a main body constituting an exterior of the microwave oven;

a cooking cavity contained in the main body, and having an upper surface, a lower surface and side walls;

a flow path formed between the main body and the cooking cavity, and having a suction port formed in a side wall of the cooking cavity and a discharge port formed in the upper surface of the cooking cavity;

a circulating fan installed in the flow path for making air flow from the inside of the cooking cavity to the flow path through the suction port, and from the inside of the flow path to the inside of the cooking cavity through the discharge port; and a heater installed near said discharge port in the flow path for heating air flowing from the flow path to the inside of the cooking cavity, wherein the discharge port comprises a plurality of discharge holes arranged in a line transverse to direction of the flow path.

13. The microwave oven according to claim 12, wherein one of the plurality of discharge holes is formed at a center portion of the discharge port and the smallest among the plurality of discharge holes.

14. The microwave oven according to claim 12, wherein the heater comprises a heating element having a zigzag-curved and paralleled shape and a plurality of heating plates formed with one or more slots therein through which the heating element is inserted for enhancing heat transfer from the heating element to the air.

15. The microwave oven according to claim 14, wherein the heating element is arranged in a plane perpendicular to the flow direction of the air in order to enhance heat transfer between the heater and the air.

16. The microwave oven according to claim 14, wherein the heating element is arranged in a plane inclined relative to the flow direction of the air in order to enhance heat transfer between the heater and the air.

17. The microwave oven according to claim 14, wherein a contact protrusion is formed on a circumference of the slot of the heating plate in order to increase contact area with the heater.

18. A microwave oven comprising:

a main body constituting an exterior of the microwave oven;

a cooking cavity contained in the main body, and having an upper surface, a lower surface and side walls;

a flow path formed between the main body and the cooking cavity, and having a suction port formed in a side wall of the cooking cavity and a discharge port formed in the upper surface of the cooking cavity;

a circulating fan installed in the flow path for making air flow from the inside of the cooling cavity to the flow path through the suction port, and from the inside of the flow path to the inside of the cooking cavity through the discharge port;

a heater installed near said discharge port in the flow path for heating air flowing from the flow path to the inside of the cooling cavity; and a reflecting plate enclosing the heater together with the upper surface of the cooking cavity in order to direct radiant energy emitted from the heater to the cooking cavity, and formed with a plurality of holes in a portion thereof facing the flowing air so that the flowing air passes through the plurality of holes;

wherein the discharge port comprises a plurality of discharge holes, and the discharge holes located closer to the circulating fan are smaller in set than the discharge holes located farther from the circulating fan.

19. A microwave oven comprising:

a main body constituting an exterior of the microwave oven;

a cooking cavity contained in the main body, and having an upper surface, a lower surface and side walls;

a flow path formed between the main body and the cooking cavity, and having a suction port formed in a side wall of the cooking cavity and a discharge port formed in the upper surface of the cooking cavity;

a circulating fan installed in the flow path for making air flow from the inside of the cooking cavity to the flow path through the suction port, and from the inside of the flow path to the inside of the cooking cavity through the discharge port;

a heater installed near said discharge port in the flow path for heating air flowing from the flow path to the inside of the cooking cavity; and a reflecting plate enclosing the heater together with the upper surface of the cooking cavity in order to direct radiant energy emitted from the heater to the cooking cavity, and formed with a plurality of holes in a portion thereof facing the flowing air so that the flown air passes through the plurality of holes;

wherein the discharge port comprises a plurality of holes arranged in a line transverse to direction of the flow path.

* * * * *